United States Patent [19]

Fouke et al.

[11] Patent Number: 4,816,976

[45] Date of Patent: Mar. 28, 1989

[54] HIGH EFFICIENCY LUMINAIRE WITH HIGH ANGLE BRIGHTNESS CONTROL

[75] Inventors: Herbert A. Fouke, Newark, Ohio; John R. Brass, San Anselmo, Calif.

[73] Assignee: Manville Corporation, Denver, Colo.

[21] Appl. No.: 10,517

[22] Filed: Feb. 3, 1987

[51] Int. Cl.[4] ..... F21V 7/00; F21V 5/00

[52] U.S. Cl. ..... 362/309; 362/337; 362/300; 362/260; 362/327

[58] Field of Search ..... 362/309, 296, 300, 260, 362/327, 328, 337

[56] References Cited

U.S. PATENT DOCUMENTS 2,269,554 1/1942 Rolph ..... 362/337 X
2,818,500 12/1957 Franck ..... 362/337
3,483,366 12/1969 Wince ..... 362/337 X
3,763,369 10/1973 Lewin ..... 362/337 X
4,300,185 11/1981 Wakamatsu ..... 362/309 X

*Primary Examiner*—Larry Jones
*Attorney, Agent, or Firm*—John D. Lister; Cornelius P. Quinn

[57] ABSTRACT

A high efficiency luminaire possessing high angle brightness control. Transverse high angle brightness control is provided by a substantially parabolically shaped reflector and longitudinal high angle brightness control is provided by a trough like lens assembly including a plurality of trough shaped lenses and screening means adjoining one another.

11 Claims, 7 Drawing Sheets

HIGH EFFICIENCY LUMINAIRE WITH HIGH ANGLE BRIGHTNESS CONTROL

The present invention relates to a high efficiency luminaire with high angle brightness control and more particularly to a luminaire with a fluorescent light source having high efficiency and very low high angle light distribution.

BACKGROUND OF THE INVENTION

Luminaires used in lighting offices and many other areas require high angle brightness control. Especially in instances where video display tubes are in use it is necessary to have very good high angle brightness control to prevent reflected glare off video display tube screens. Reflected glare on video display tube screens reduces the contrast and obscures information on the screen contributing to eye strain and fatigue of the viewer.

Previously, small cell parabolic louvers have frequently been used to provide the high angle brightness control required, however these devices have the disadvantage of low efficiency or low coefficients of utilization.

Luminaires using conventional light controlling lenses or large cell parabolic louvers have much higher efficiencies than luminaires using small cell parabolic louvers but they do not have the necessary high angle brightness control.

It is the principal object of the present invention to provide a luminaire with high brightness control and coefficients of utilization.

SUMMARY OF THE INVENTION

Accordingly, the present invention provides a luminaire comprising a fluorescent light source; with a first reflector means for providing transverse high angle brightness control and a second lens means for providing longitudinal high angle brightness control

DESCRIPTION OF THE INVENTION

Figure 1:
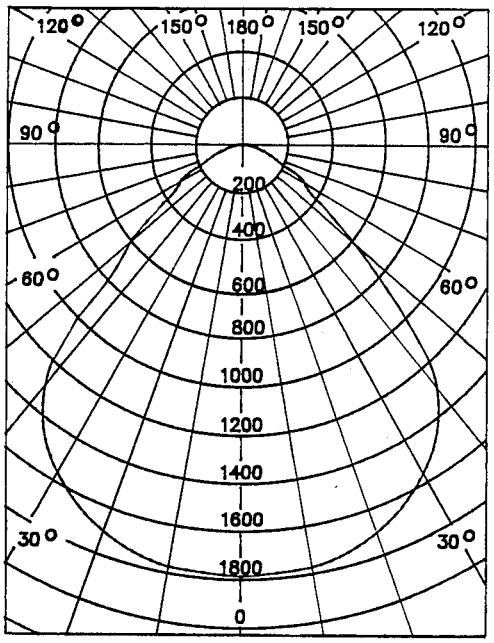
FIG. 1 shows a typical transverse light distribution produced by a luminaire using a conventional cone prism lens.

Referring to the Drawings, FIG. 1 shows the transverse light distribution produced by a conventional cone prism lens. With a luminaire utilizing such a lens transverse photometric tests indicate that 55.5% of the total lumens are distributed from °-60° and 6.6% of the total lumens are distributed from 60°-90°.

Figure 9:
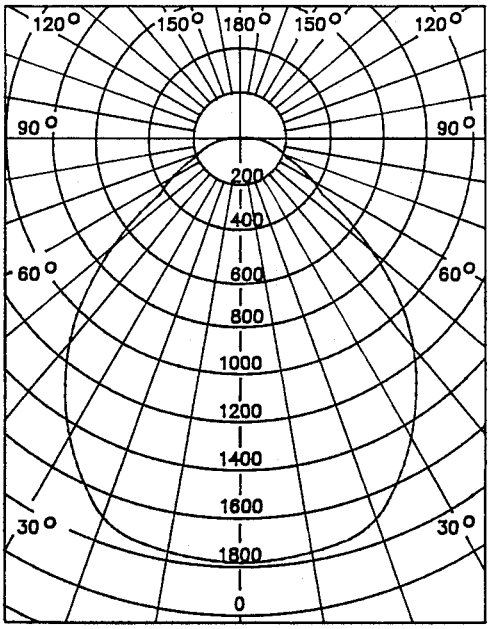
FIG. 9 shows a typical longitudinal light distribution produced by a luminaire using a conventional cone prism lens.

FIG. 9 shows the longitudinal light distribution produced by the same conventional cone prism lens referred to in FIG. 1. With a luminaire using such a lens longitudinal photometric tests indicate that 55.6% of the total lamp lumens are distributed from 0°-60° and 6.4% of the total luminaires are distributed from 60°-90°.

Figure 2:
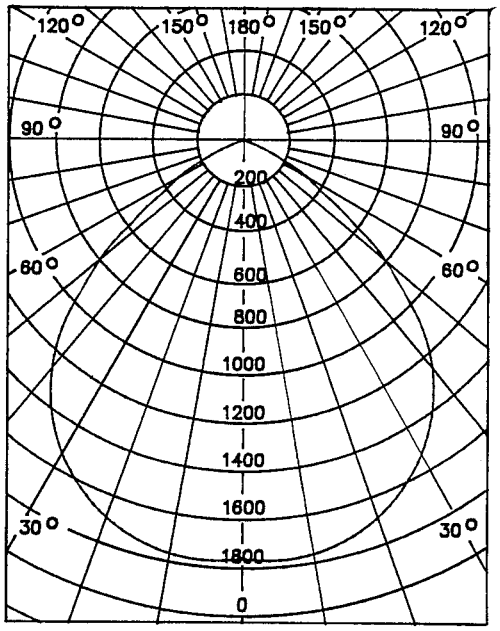
FIG. 2 shows the transverse light distribution of a luminaire with a low brightness lens such as the refractive grid disclosed in U.S. Pat. No. 3,763,369.

FIG. 2 shows the transverse light distributed produced by a luminaire with a low brightness lens such as the refractive grid disclosed in U.S. Pat. No. 3,763,369. With such a lens transverse photometric tests indicate that 57.4% of the total lamp lumens are distributed between 0°-60° and 3.6% of the total lamp lumens are distributed between 60°-90°.

Figure 8:
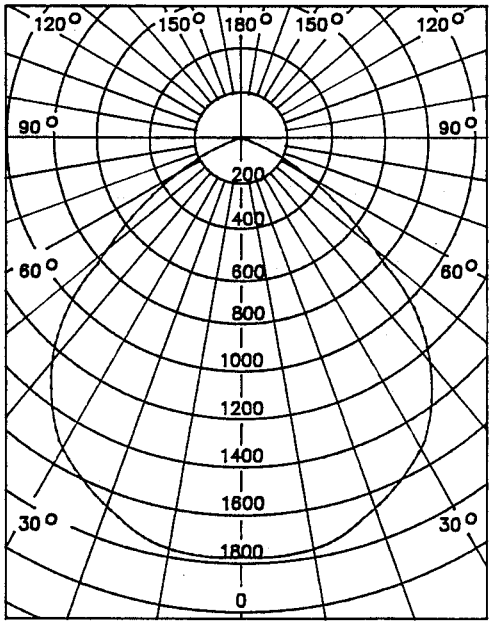
FIG. 8 shows the longitudinal light distribution with a low brightness lens such as in the refractive grid disclosed in U.S. Pat. No. 3,763,369.

FIG. 8 shows the longitudinal light distribution produced by the same refractive grid referred to in FIG. 2. With a luminaire using such a lens the longitudinal photometric tests indicate that 57.6% of the total lamp lumens are distributed between 0°-60° and 3.4% of the total lamp lumens are distributed between 60°-90°.

Figure 3:
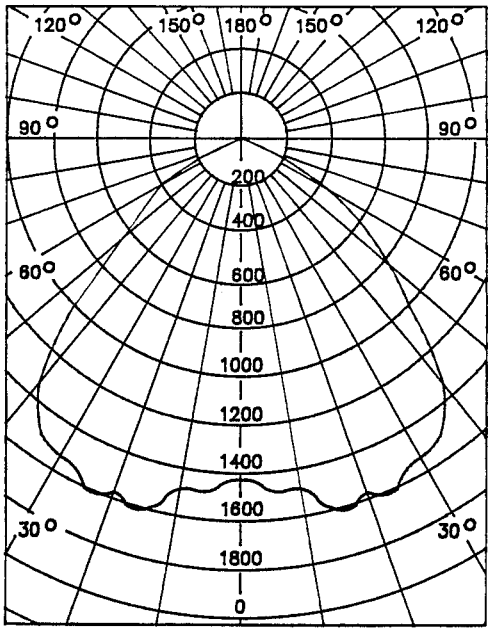
FIG. 3 shows the transverse light distribution of a luminaire with a typical large cell parabolic louver.

FIG. 3 shows the transverse light distribution produced by a luminaire with a typical large cell parabolic louver. With such a louver transverse photometric tests indicate that 53.4% of the total lamp lumens are distributed between 0°-60° and 2.4% of the total lamp lumens are distributed between 60°-90°.

Figure 7:
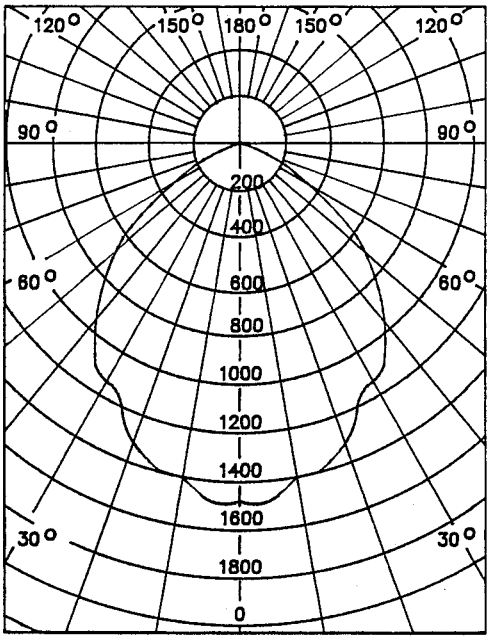
FIG. 7 shows the longitudinal light distribution wih a typical large cell parabolic louver.

FIG. 7 shows the longitudinal light distribution produced by the same lunimaire with a typical large cell parabolic louver referred to in FIG. 2. With a luminaire using such a louver the longitudinal photometric tests indicate that 53.4% of the total lamp lumens are distributed from 0°-60° and 2.4% of the total lumens are distributed between 60°-90°.

Figure 4:
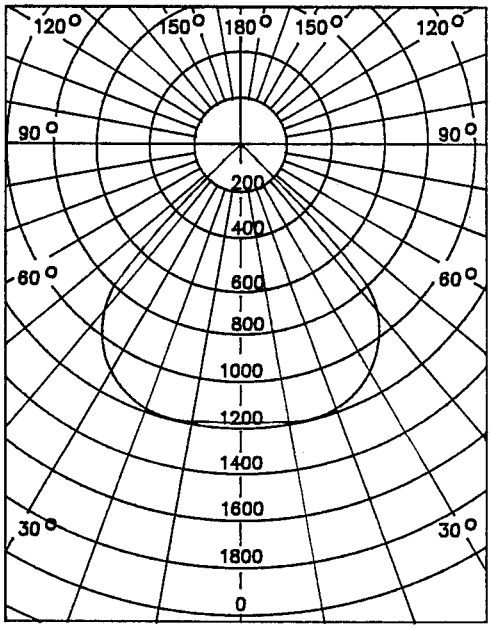
FIG. 4 shows the transverse light distribution by a luminaire with a typical small cell louver.

FIG. 4 shows the transverse light distribution produced by a luminaire with a typical small cell louver. With a luminaire using such a louver the transverse photometric tests indicate that 29.9% of the total lumens are distributed between 0°-60% and substantially none are distributed between 60°-90°.

Figure 10:
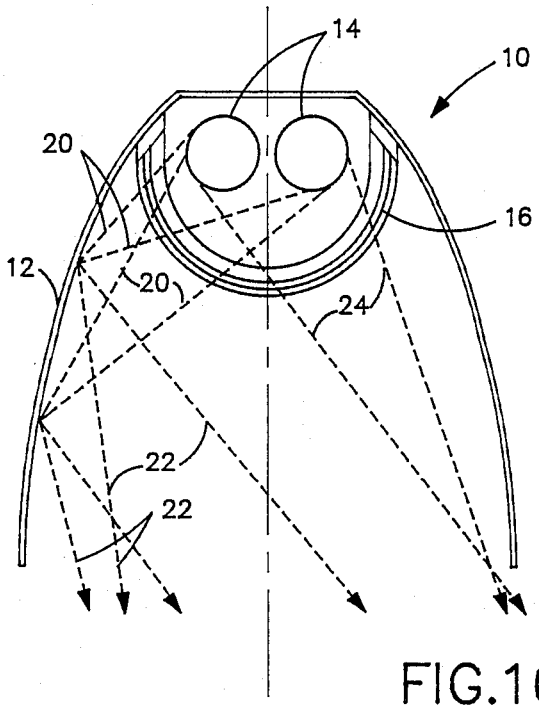
FIG. 10 is a transverse section of a luminaire made in accordance with the present invention.

In the present invention as shown in FIG. 10 in transverse section the luminaire generally identified by the reference numeral 10 is provided with a substantial parabolic shaped reflector 12.

A fluorescent lamp 14 which may be of the twin tube type or a conventinal single tube, provides light in the luminaire 10. The luminaire 10 is provided with a trough shaped lens 16 for controlling the light longitudinally.

As illustrated in FIG. 10 light rays 20 from the fluorescent lamp 14 are reflected from the reflector 12 as reflected light rays 22, the highest angle of which at an angle at or near the highest angle at which a direct light ray 24 is emitted from the lamp 14. Thus the substantially parabolic reflector 12 provides transverse cutoff of light at angles above 55° which effectively prevents any reflected glare in video display tube screens at normal viewing angles.

Figure 11:
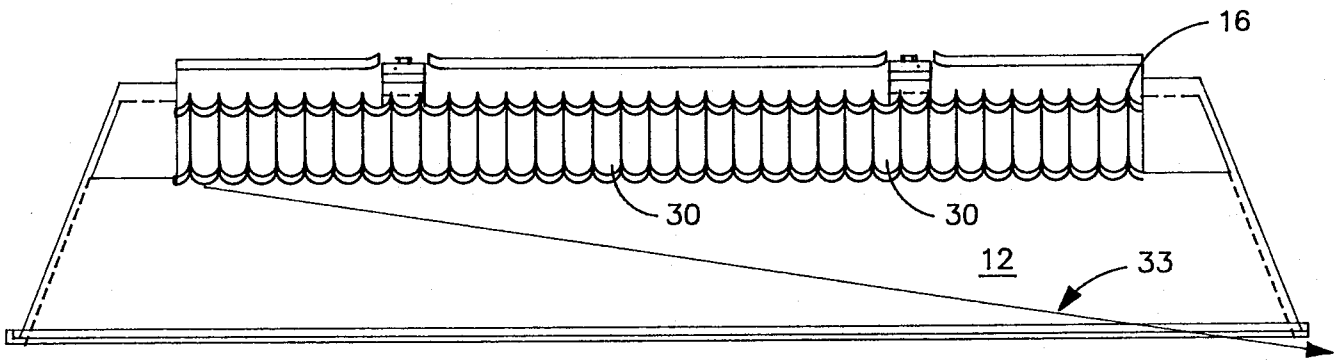
FIG. 11 is a longitudinal cross section of a luminaire made in accordance with the present invention.
Figure 12:
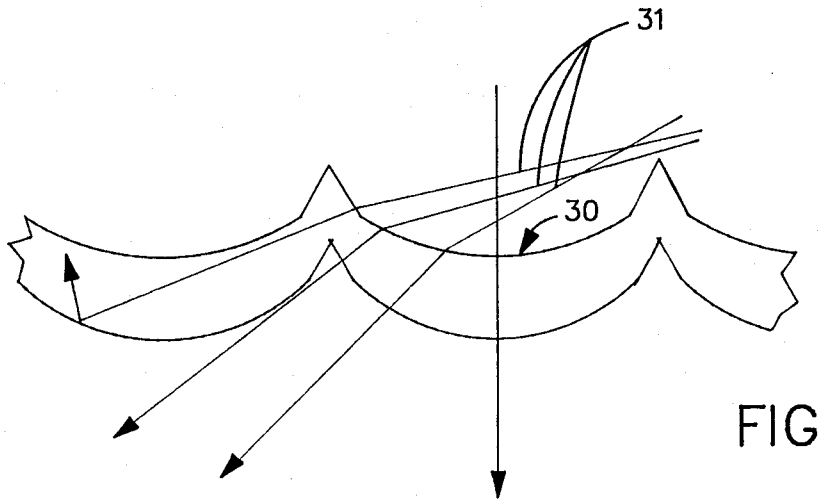
FIG. 12 is an enlarged partial longitudinal cross section of the lens of the luminaire shown in FIG. 7.

As illustrated in FIGS. 11 and 12 the trough shaped lens assembly 16 is made up of a series of transverse lenses 30. This trough shaped lens assembly 16 is somewhat similar to the circular lens described in U.S. Pat. No. 3,763,369. Light rays 31 enter the lens 30 and emerge at lower angles or are internally reflected. Longitudinal brightness control is provided by the lens assembly 16 with absolute cutoff not occurring until a high angle, as shown by rays 33.

Figure 13:
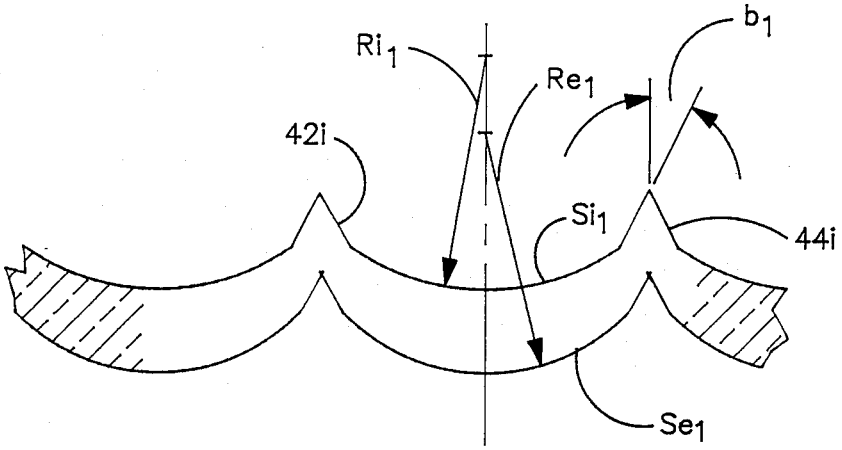
FIGS. 13 and 14 are enlarged partial longitudinal cross sections of the lens of the luminaire shown in FIG. 7.

Each lens 30 as shown in FIG. 13 has a concave light incident surface Si, and a convex emergent surface $Se_1$. The radii of curvature of these two surfaces being identified respectively as $Ri_1$ and $Re_1$ are constant for each of the transverse lens' 30.

In order to prevent the lenses 30 from being struck by high angle light rays optical screening elements 40i are provided. The screening elements 40*i* extend upwardly from the uppermost extensions of 42*i* of light incident surfaces 44*i* which are inclined from the vertical by a certain angle 6. The arrangement of these surfaces is to establish a generally prismatic element of triangular cross-section with the lens adjacent each other.

The lens assembly 16 can be formed readily from either glass or plastic material by the use of simple die-formed mold structures or other well-known procedures.

Figure 14:
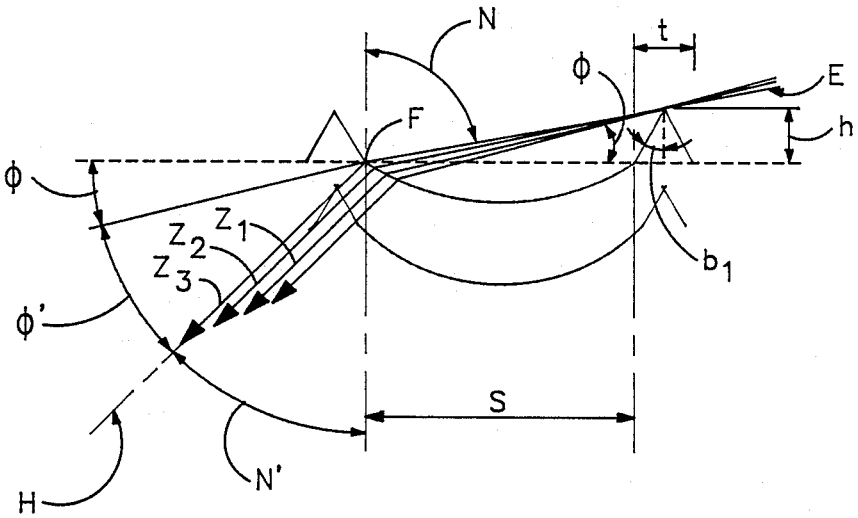

FIG. 14 shows the highest angle ray E, which can pass over the screening elements 40, and be directly incident on the light incident concave surface Si. This ray makes an angle of $\phi°$ with the horizontal. It strikes the lens at an angle of N° from nadir, where $N°=90°-\phi°$. Lens 30 lowers this high-angle ray by an angle of N°=°, whereby the light ray will be emitted, as H, at an angle of o'°, from nadir where $N'°=90°-\phi°-\phi'0°$. Essentially all other light rays which directly strike surface Si, are distributed at angles which are less than or equal to N'. By means of preventing emission in the glare zone while allowing emission at angles close to the glare zone, as shown by FIG. 14 ($Z_1$, $Z_2$, $Z_3$), a widespread distribution of light is achieved giving improved uniformity of illumination. In this respect, it is noted that Ray $Z_2$ is emitted at a slightly greater angle than H.

It is desired, to distribute all light from the luminaire at angles N' from 0° to 60° nadir, in order to suppress high-angle or glare light that would be distributed at angles between 60° and 90° nadir. Accordingly, elements 40 are optimally designed so that angle N' is at most 60°. This angle N' is a function of the height of the screening element 40, the element thickness, the diameter of the light incident surface Si, the curvature radius of Si and the curvature of Se.

Figure 5:
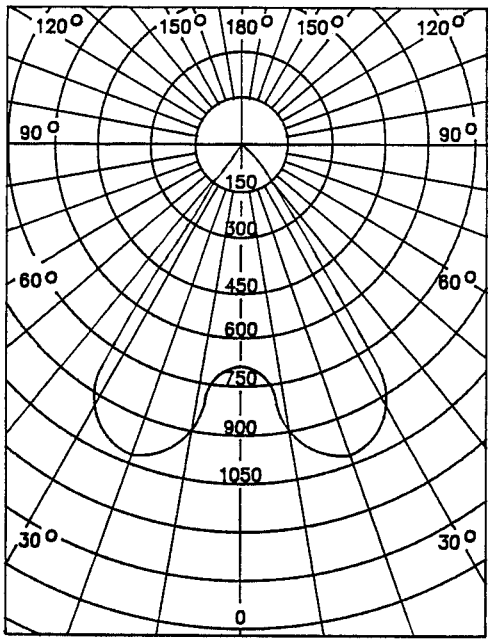
FIG. 5 shows the transverse light distribution produced by the luminaire in accordance with the present invention.

As illustrated in FIG. 5 showing the transverse distribution of light for the present invention, the photometric tests indicate that 57.7% of the total lamp lumens are distributed from 0°-60° and only 0.7% of the total lamp lumens are projected in the 60°-90° range.

Figure 6:
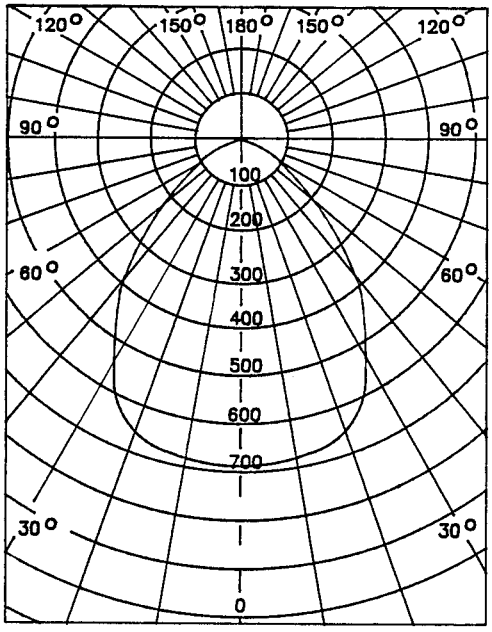
FIG. 6 shows the longitudinal light distribution produced by the luminaire in accordance with the present invention.

Likewise FIG. 6 illustrating the longitudinal light distribution of the present invention shows that 57.7% of the total lamp lumens are distributed between 0°-60° and only 0.7% of the total lamp lumens are projected in the 60°-90° range.

We claim:

1. A luminaire comprising a fluorescent light source, a first reflector means for providing transverse high angle brightness control and a second lens means for providing longitudinal high angle brightness control said means for providing longitudinal high angle brightness control including a plurality of trough shaped lenses and screening means adjoining one another as a network, each of said lenses including a concave light incident surface opposite said light source and a convex light emergent surface, the radius of curvature of the light incident source of each lens being greater than the radius of curvature of the light emergent surface thereof whereby said lenses lower relatively high-angle light incident on their light-incident surfaces, so that such light emerges from their light emergent surfaces at smaller angles from nadir, and the screening means comprising means for preventing light arriving from the light source at extremely high angles from nadir, from directly striking said lenses, each of said screening means having a light incident surface which comprises means for refractively lowering high-angle light incident thereon.

2. A luminaire comprising a fluorescent light source, a first reflector means for providing transverse high angle brightness control and a second lens means for providing longitudinal high angle brightness control, said means for providing longitudinal high angle brightness control including a plurality of trough shaped lenses and screening means adjoining one another as a network, each of said lenses including a concave light incident on their light-incident surfaces, so that such light emerges from their light emergent surfaces at smaller angles from nadir, and the screening means comprising means for preventing light, arriving from the light source at extremely high angles from nadir, from directly striking said lenses, each of said screening having a light incident surface which comprises means for refractively lowering high-angle light incident thereon.

3. A luminaire comprising a fluorescent light source, a first reflector means for providing transverse high angle brightness control and a second lens means for providing longitudinal high angle brightness control, said first means for providing transverse high angle brightness control including a substantially parabolically shaped reflector, said means for providing longitudinal high angle brightness control including a plurality of trough shaped lenses and screening means adjoining one another as a network, each of said lenses including a concave light incident surface opposite said light source and a convex light emergent surface, said concave light incident surfaces having uppermost extensions comprising said screening means, whereby said lenses lower relatively high-angle light incident on their light-incident surfaces, so that such light emerges from their light emergent surfaces at smaller angles from nadir, and the screening means comprising means for preventing light, arriving from the light source at extremely high angles from nadir, from directly striking said lenses.

4. A luminaire comprising a fluorescent light source, a first reflector means for providing transverse high angle brightness control and a second lens means for providing longitudinal high angle brightness control, said means for providing longitudinal high angle brightness control including a plurality of trough shaped lenses and screening means adjoining one another as a network, each of said lenses including a concave light incident surface opposite said light source and a convex light emergent surface, said concave light incident surfaces having uppermost extensions comprising said screening means, the radius of curvature of the light incident surface of each lens being greater than the radius of curvature of the light emergent surface thereof whereby said lenses lower relatively high-angle light incident on their light-incident surfaces, so that such light emerges from their light emergent surfaces at smaller angles from nadir, and the screening means comprising means for preventing light, arriving from the light source at extremely high angles from nadir, from directly striking said lenses.

5. A luminaire comprising a fluorescent light source, a first reflector means for providing transverse high angle brightness control and a second lens means for providing longitudinal high angle brightness control, said means for providing longitudinal high angle brightness control including a plurality of trough shaped lenses and screening means adjoining one another as a network, each of said lenses including a concave light incident surface opposite said light source and a convex light emergent surface, said light incident surfaces having uppermost extensions and said screening means comprising generally prismatic means extending upwardly from said extensions, whereby said lenses lower relatively high-angle light incident on their light-incident surfaces, so that such light emerges from their light emergent surfaces at smaller angles from nadir, and the screening means comprising means for preventing light, arriving from the light source at extremely high angles from nadir, from directly striking said lenses.

6. A luminaire comprising a fluorescent light source, a first reflector means for providing transverse high angle brightness control and a second lens means for providing longitudinal high angle brightness control said means for providing longitudinal high angle brightness control including a plurality of trough shaped lenses and screening means adjoining one another as a network, each of said lenses including a concave light incident surface opposite said light source and a convex light emergent surface, the radius of curvature of the light incident source of each lens being greater than the radius of curvature of the light emergent surface thereof whereby said lenses lower relatively high-angle light incident on their light-incident surfaces, so that such light emerges from their light emergent surfaces at smaller angles from nadir, and the screening means comprising means for preventing light arriving from the light source at extremely high angles from nadir, from directly striking said lenses, each of said screening means having a light incident surface which comprises means for refractively lowering high-angle light incident thereon, and wherein more than 45% of the total lamp lumens produced from said fluorescent light source is distributed in the 0°-60° range and less than 1% of the total lamp lumens produced from said fluorescent light source is distributed in the 60°-90° range.

7. A luminaire comprising a fluorescent light source having lens means for providing longitudinal high angle brightness control, said lens means for providing longitudinal high angle brightness control including a plurality of trough shaped lenses and screening means adjoining one another as a network, each of said lenses including a concave light incident surface opposite said light source and a convex light emergent surface, the radius of curvature of the light incident source of each lens being greater than the radius of curvature of the light emergent surface hereof whereby said lenses lower relatively high-angle light incident on their light-incident surfaces, so that such light emerges from their light emergent surfaces at smaller angles from nadir, and the screening means comprising means for preventing lgiht arriving from the light source at extremely high angles from nadir, from directly striking said lenses, each of said screening means having a light incident surface which comprises means for refractively lowering high-angle light incident thereon.

8. A luminaire comprising a fluorescent light source having lens means for providing longitudinal high angle brightness control, said lens means for providing longitudinal high angle brightness control including a plurality of trough shaped lenses and screening means adjoining one another as a network, each of said lenses including a concave light incident surface opposite said light source and a convex light emergent surface, whereby said lenses lower relatively high-angle light incident on their light-incident surfaces, so that such light emerges from their light emergent surfaces at smaller angles from nadir, and the screening means comprising means for preventing light, arriving from the light source at extemely high angles from nadir, from directly striking said lenses, each of said screening having a light incident surface which comprises means for refractively lowering high-angle light incident thereon.

9. A luminaire comprising a fluorescent light source having lens means for providing longitudinal high angle brightness control, said means for providing longitudinal high angle brightness control including a plurality of trough shaped lenses and screening means adjoing one another as a network, each of said lenses including a concave light incident surface opposite said light source and a convex light emergent surface, said concave light incident surfaces having uppermost extensions comprising said screening means, the radius of curvature of the light incident surface of each lens being greater than the radius of curvature of the light emergent surface thereof whereby said lenses lower relatively high-angle light incident on their light-incident surfaces, so that such light emerges from their light emergent surfaces at smaller angles from nadir, and the screening means comprising means for preventing light, arriving from the light source at extremely high angles from nadir, from directly striking said lenses.

10. A luminaire comprising a fluorescent light source having lens means for providing longitudinal high angle brightness control, said means for providing longitudinal brightness control including a plurality of trough shaped lenses and screen means adjoining one another as a network, each of said lenses including a concave light incident surface opposite said light source and a convex light emergent surface, said light incident surfaces having uppermost extensions and said screening means comprising generally prismatic means extending upwardly from said extensions, the radius of curvature of the light incident surface of each lens being greater than the radius of curvature of the light emergent surface thereof whereby said lenses lower relatively high-angle light incident on their light-incident surfaces, so that such light emerges from their light emergent surfaces at smaller angles from nadir, and the screening means comprising means for preventing light, arriving from the light source at extremely high angles from nadir, from directly striking said lenses.

11. A luminaire as recited in claim 10 wherein more than 45% of the total lamp lumens produced from said fluorescent light source is distributed in the 0°-60° range and less than 1% of the total lamp lumens produced from said fluorescent light source is distributed in the 60°-90°0 range.

* * * * *